US007382323B2

(12) United States Patent
Hu et al.

(10) Patent No.: US 7,382,323 B2
(45) Date of Patent: Jun. 3, 2008

(54) MICRO CHIP ANTENNA

(75) Inventors: Chuan Ling Hu, Taipei Hsien (TW); Meng Chiu Pan, Taipei Hsien (TW); Shun Tian Lin, Taipei (TW); Chang Fa Yang, Taipei (TW); Kao Chung Cheng, Taipei (TW); Sea Fue Wang, Taipei (TW); Lisen Chang, Taipei (TW); Chang Lun Liao, Taipei (TW); Chia Hung Chen, Taipei (TW)

(73) Assignee: Chant Sincere Co., Ltd., Taipei Hsien (TW)

( * ) Notice: Subject to any disclaimer, the term of this patent is extended or adjusted under 35 U.S.C. 154(b) by 0 days.

(21) Appl. No.: 11/036,015

(22) Filed: Jan. 18, 2005

(65) Prior Publication Data

US 2006/0158377 A1 Jul. 20, 2006

(51) Int. Cl.
*H01Q 1/24* (2006.01)

(52) U.S. Cl. ..... 343/702

(58) Field of Classification Search ..... 343/702, 343/700 MS, 895, 873

See application file for complete search history.

(56) References Cited

U.S. PATENT DOCUMENTS

| | | | | |
|---|---|---|---|---|
| 5,870,066 | A * | 2/1999 | Asakura et al. | 343/895 |
| 6,023,251 | A * | 2/2000 | Koo et al. | 343/895 |
| 6,353,443 | B1 * | 3/2002 | Ying | 715/702 |
| 6,686,884 | B2 * | 2/2004 | Back et al. | 343/700 MS |
| 6,734,825 | B1 * | 5/2004 | Guo et al. | 343/700 MS |
| 6,950,065 | B2 * | 9/2005 | Ying et al. | 343/700 MS |
| 2003/0214441 | A1 * | 11/2003 | Back et al. | 343/700 MS |
| 2004/0263420 | A1 * | 12/2004 | Werner et al. | 343/909 |
| 2005/0110684 | A1 * | 5/2005 | Liu | 343/700 MS |

* cited by examiner

*Primary Examiner*—Huedung Mancuso
(74) *Attorney, Agent, or Firm*—Bacon & Thomas, PLLC

(57) ABSTRACT

A method for manufacturing microchip antenna comprises a dielectric substrate having antenna radiation conductor paths composing of at least one feeding point and multiple-curved paths; a dielectric substrate having the antenna radiation conductor paths being packaged by the material capable of adjusting easily dielectric constant; and an antennal object including antenna radiation conductor paths, feeding ends, welding spots and packaging materials. The main body of the antenna has multi-folded paths, feeding ends, welding spots, and a packaging body. The radiation wires of the antenna is built on a single or a multiple input ends on a dielectric substrate and is multi-folded wires and it is packaged by another dielectric material. The radiation wires of the antenna can be designed and manufactured in three dimension so as to reduce the area occupied by the antenna and reduce the coupling interference between the elements.

9 Claims, 5 Drawing Sheets

MICRO CHIP ANTENNA

FIELD OF THE INVENTION

The present invention relates to micro chip antenna, and in particular to a method for manufacturing a microchip antenna. The main body of the antenna includes multi-folded paths, feeding points, welding spots, and a packaging body. The radiation wires of the antenna is built on a single or multiple inputs on a dielectric substrate and is multi-folded wires. It is packaged by another dielectric material. The radiation wires of the antenna can be designed and manufactured in three dimensions so as to reduce the area occupied by the antenna and reduce the coupling interference between the elements. Thereby the dielectric constant of the packaging material can be changed to increase the degree of freedom in the design and application of the antenna. Thereby antenna can be designed to have multiple frequency bands, be wideband and have an improved radiation pattern.

BACKGROUND OF THE INVENTION

Wireless transmission is more and more popular due to the unlimited applications of the wireless technology. It is widely used in many fields, such as satellite communication, handset communication, or wireless networks. All these facilities apply technique of wireless transmission. However in wireless communication, antenna is an important element, which is used in electromagnetic wave transmission and receiving. Since an antenna is like a liaison among the wireless products. Antennas are supposed to be a key component for its widespread business usage in the future. In order to reduce the cost of manufacture and fit the design criteria, such as small size, light weight, thin or short sizes, how to design and manufacture antenna becomes an important issue.

Chip antennas are a kind of antenna type and are developed recently. This type of antenna packages metal conductor into dielectric material. As far as we know, if electromagnetic wave spreads in the material having higher dielectric constant, then the wave speed will slow down for the sake of material property and the wavelength becomes shorter. The size of antenna will depend on its wavelength. If the wavelength is longer, then the size of antenna will become larger. On the other hand, if the wavelength is shorter, then the size of antenna can be smaller. If the dielectric constant of packaging material is higher, then the whole volume of antenna can be smaller. Almost all products of wireless transformation tend to a trend of compactness, so the invention of chip antenna is very useful for the future development of wireless transformation.

As the prior art techniques is presented in Taiwan Patent No. 480773 The type of antenna starts the stage of three-dimensional structure and apply the technique of low temperature co-combustion (LTTC). However, the manufacturing process of LTTC is very complicated and expensive. In the manufacturing process of LTTC, radiated conductor paths use conductive material plane-printing technology on a ceramic substrate, and then on its adjacent two layers of substrates. Corresponding wire ends form through holes to connect each other. To fill the passing through hole with conductive material to connect the two layers of circuits, this process can build up a three-D structure. Finally, sintering the antenna uses the mean of LTTC (about 800° C.~900° C.) and composes it into a single unit. Manufacturing process of LTTC limits the choice of conductive circuit and dielectric material. Besides, it also has the problem of sintering contraction and deformation of conductive wires. Because of the disadvantages of LTTC, such as more complex manufacturing process, huger amount of investing cost and lower degree of freedom for antenna designing, those disadvantages leads to increasing the time of preparation for exploiting new products and the increasing cost in research and development. Therefore, LTTC is not qualified to be an efficiency and suitable manufacturing process.

Another example of prior art is presented in Taiwan Patent No. 518801, "chip antenna and method of manufacturing process thereof". The invention presents a method for packaging partly metal sheet of conductive loop of an antenna by conductive material, then using residue of the loop to follow the surface of the packaged dielectric material for curving. The invention can reduce the measure of area on the substance of antenna. However, the manufacturing process of the antenna is quite complicated and it is difficulty to control the function of antenna.

Besides, another one example of the prior art is presented in the invention of U.S. Pat. No. 6,636,180. The invention presents a type of printing circuit antenna. The kind of micro-strip antenna includes a printed circuit board, metal chips and multiple curved circuits. The metal chips services as grounded surface. On the top and bottom of printed circuit board has conductive circuits and uses through holes to connect therewith so as to form continuous conductive framework, in order to reduce the size of the antenna, but the conductor loop of the antenna is exposed to user's environment. According to the change of user's nearby environment, the residue of the loop central frequency may increase and has different variations.

Above-mentioned prior arts can only produce specific antenna used in particular frequencies. Applying those methods to antenna often has different degree of shifts to the center frequency due to the displacement of the antenna. In the 2.45 GHz of central frequency, the shift can be 200 MHz. If try to calibrate the shift by modifying the antenna loop, that will be complicated and be a huge work. Therefore, the central frequency usually is adjusted by adding capacitor and inductor to the exterior circuits. The solution will increase producing cost and reduce the measure of PC board. Besides, the degree of freedom to apply antenna will reduce.

SUMMARY OF THE INVENTION

Figure 1:
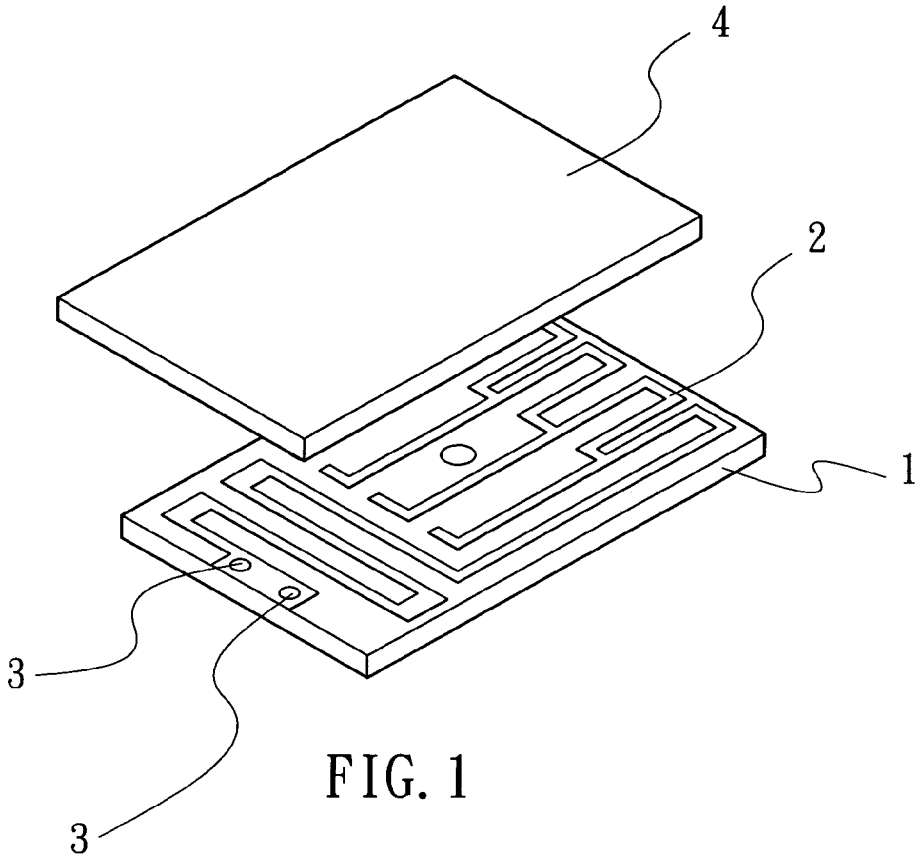
FIG. 1 is a cross-sectional view for the first embodiment of the invention.

The primary objective of the present invention is to provide a method for manufacturing microchip antenna comprises a dielectric substrate having antennal radiated conductor paths composing of a single-feeding end or multiple-feeding ends and multiple-curved paths; the dielectric substrate having the antennal radiated conductor paths being packaged by the material capable of adjusting easily dielectric constant; and an antennal object including antennal radiated conductor paths, feeding points, welding sports and packaging materials.

Furthermore, the resin-ceramic compound material capable of fine-adjusting the dielectric constant thereof easily is processed into thermal plastic high molecular materials, or thermal setting high molecular materials, and ceramic powders or fiber with various components and ratios; the dielectric constant is adjusted by adjusting the components and ratios.

The conductor loop is processed by the ways of exposure, development, etching, electroplating, non-electroplate, screen printing sintering, sputtering or printing as to establish the conductor loop on a dielectric substrate with a specific dielectric constant. The dielectric substrate with the conductor paths is packaged by embedding type injection molding, two-material injection molding, mold-filling, screen thick firm printing, transfer printing or stacking so as to package dielectric material to the dielectric substrate with conductor paths.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

The present invention is related to a method for manufacturing a microchip antenna. The method applies a simulation software to establish a simulated framework of a microchip antenna. Then the conductor loop is processed by the ways of exposure, development, etching, electroplating, non-electroplate, screen printing sintering, sputtering or printing so as to establish the conductor loop on a dielectric substrate with a specific dielectric constant. The dielectric constant of dielectric substrate can be defined between 2 to 30. Besides the dielectric substrate can be one of a printed circuit board, a plastic board, a resin board, a resin-ceramic compound board, a ceramic board or a wafer according to actual needs of manufacturers. By using the dielectric substrate, the resin-ceramic compound board or plastic board with a specific dielectric constant is packaged into dielectric substances with conductor paths thereon. That uses the techniques of embedding type injection molding, two-material injection molding, mold-filling, screen thick firm printing, transfer printing or stacking to form the micro-antenna finally. The dielectric constant of packaging material is changed slightly by the ways of adjusting antenna of reflection loss and central frequency.

The resin of the above-mentioned resin-ceramic compound board is one of a thermal plastic high molecular material or a thermal setting high molecular material. The dielectric substrate may be a single-layer substrate or a multi-layers substrate with the same or different dielectric constants.

Figure 2:
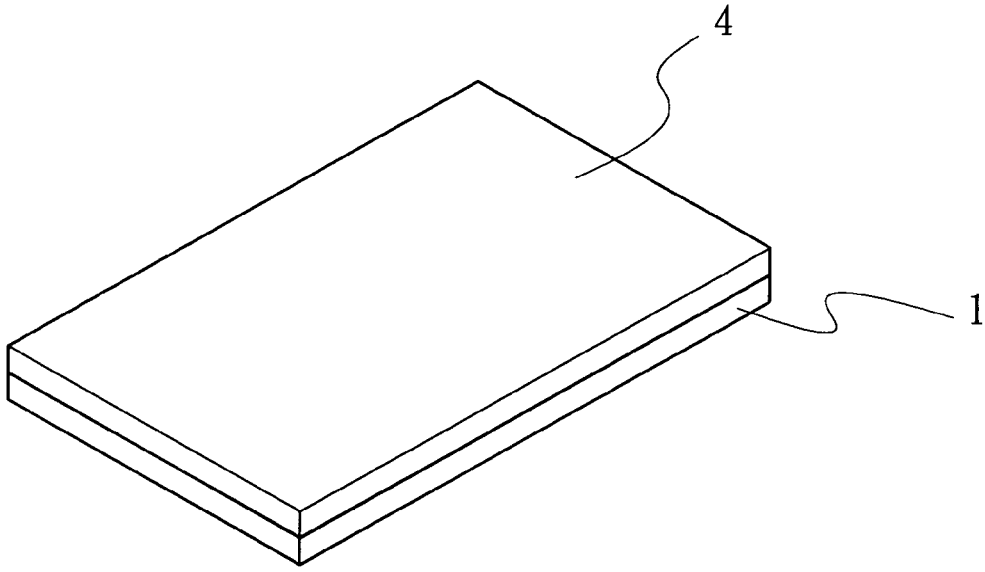
FIG. 2 is a top perspective view of the first embodiment of the invention.

Referencing to FIGS. 1 and 2, an embodiment of the invention is based on a dielectric substrate 1, forming by a printed circuit board, a resin board, a resin-ceramic compound board, a ceramic board or a wafer. The conductor loop 2 is established by various composing methods, such as exposure, development, etching, electroplating or non-electroplating. The conductor loop 2 contains one feeding point 3 which passes through the dielectric substrate 1 to another feeding point 3 on the other side of dielectric substrate 1. The alternative way is to drill holes in the dielectric substrate 1 and constitute the extending conductor loop for increasing the length of the conductor. Then, a packaging material, in this embodiment a resin-ceramic compound board 4, comprised of a material capable of fine-adjusting the dielectric constant thereof easily, is packaged over the conductor loop by using the techniques of injection molding, mold-filling, thick firm printing, screen printing, transfer printing or stacking. The dielectric constant of the resin-ceramic compound board 4 is changed for adjusting the central frequency of the reflection loss of the antenna.

The above-mentioned packaging material (resin-ceramic compound board 4) comprises thermal plastic high molecular materials or thermal setting high molecular materials, and ceramic powders or fiber with various components and ratios. The dielectric constant is adjusted by adjusting the components and ratios.

Referencing to Table 1 and 2, two types o antenna are presented to show different influences for their various designs of applying environmental antennal reflection loss for changing dielectric constant in the central frequency of resin-ceramic compound board.

Tables 1 and 2 illustrate that it is unnecessary to change the framework of the lower substrate 1 of the antenna and the conductor loop 2, while it is only necessary to change the component (or dielectric constant) of packaging material 4 (e.g. resin-ceramic compound board), so that a unique microchip antenna can be produced.

TABLE 1

| Dielectric constant of resin-ceramic compound board | Environment of nearby antenna | Central Frequency (GHz) | Bandwidth (MHz) |
|---|---|---|---|
| 5.0 | air | 2.31 | 200 |
| 5.0 | Casing of net wires and net cards | 2.18 | 180 |
| 4.0 | air | 2.46 | 220 |
| 4.0 | Casing of net wires and net cards | 2.34 | 190 |
| 3.7 | Air | 2.53 | 220 |
| 3.7 | Casing of net wires and net cards | 2.41 | 200 |

TABLE 2

| Dielectric constant of resin-ceramic compound board | Environment of nearby antenna | Central Frequency (GHz) | Bandwidth (MHz) |
|---|---|---|---|
| 27 | Air | 2.40 | 160 |
| 27 | Casing of net wires and net cards | 2.34 | 160 |
| 26 | Air | 2.45 | 180 |
| 26 | Casing of net wires and net cards | 2.38 | 170 |
| 25 | Air | 2.54 | 180 |
| 25 | Casing of net wires and net cards | 2.46 | 170 |

Figure 3:
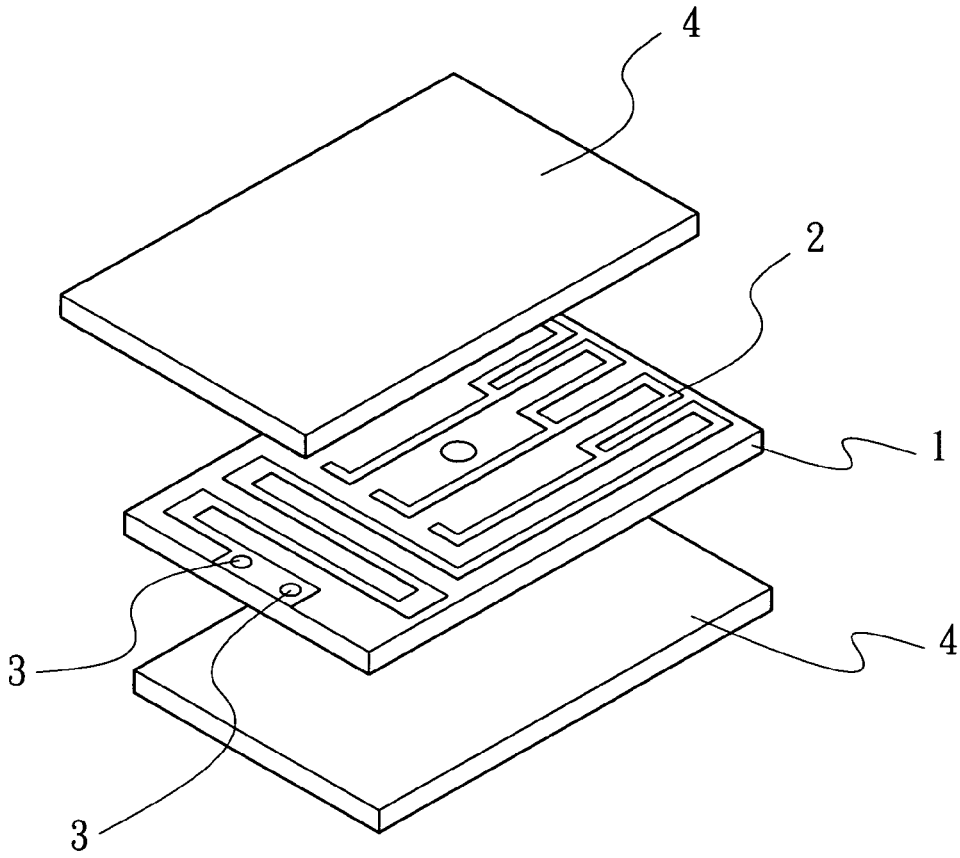
FIG. 3 is a cross-sectional view for the second embodiment of the invention.
Figure 4:
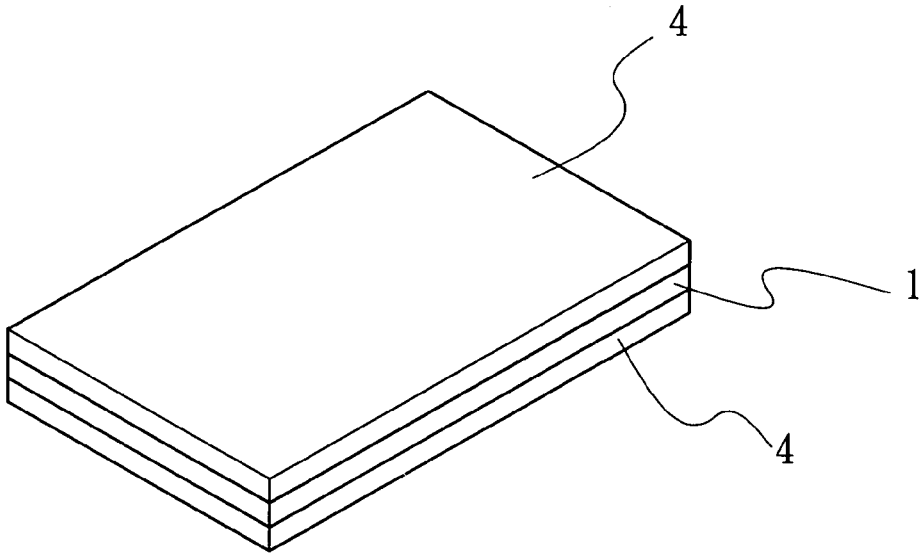
FIG. 4 is a top perspective view of the second embodiment of the invention.
Figure 5:
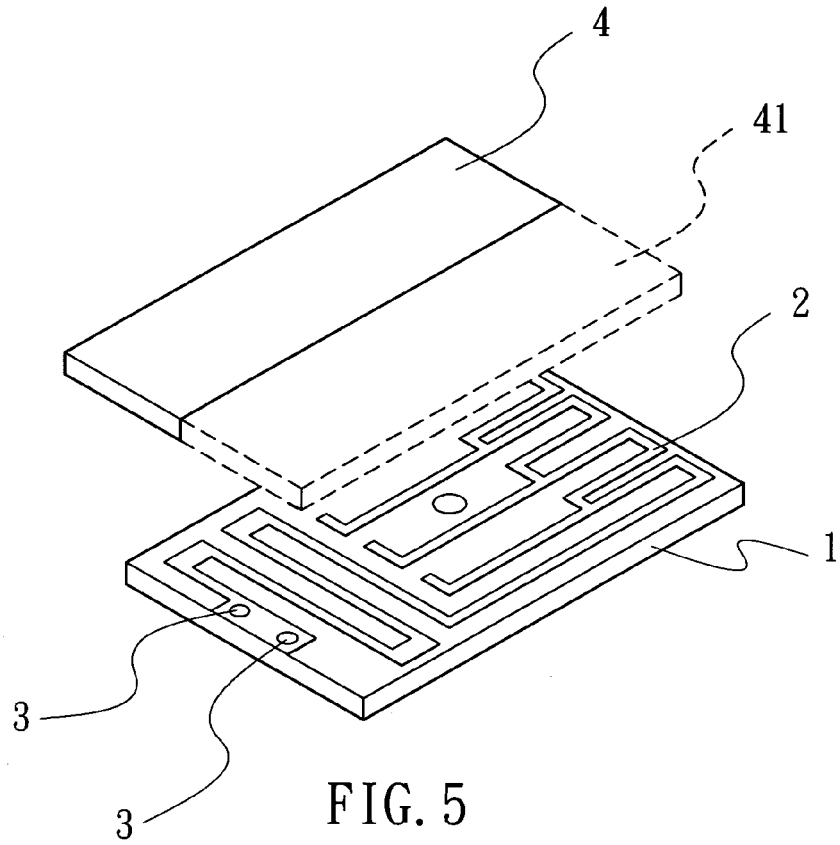
FIG. 5 is a cross-sectional view for the third embodiment of the invention.
Figure 6:
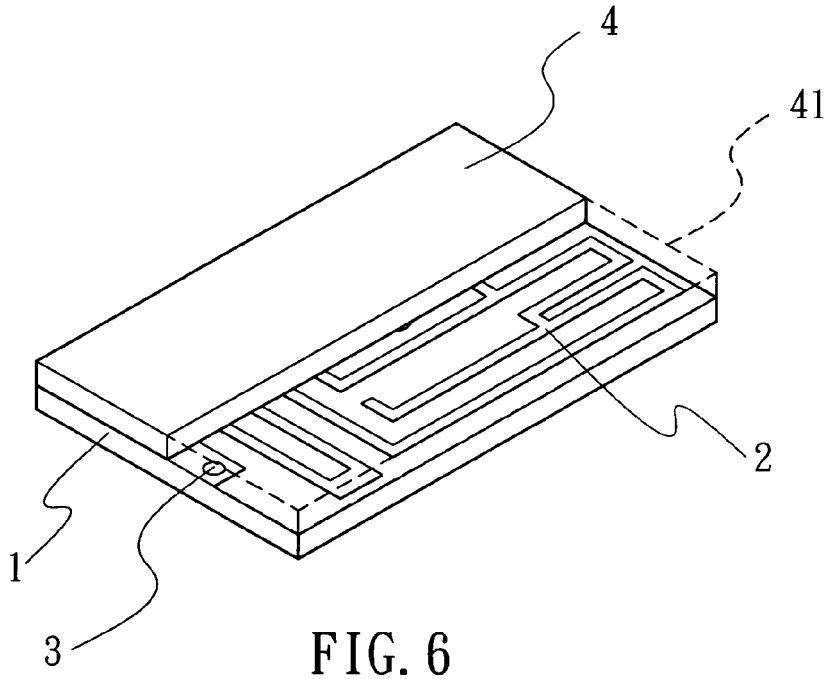
FIG. 6 is a top perspective view of the third embodiment of the invention.
Figure 7:
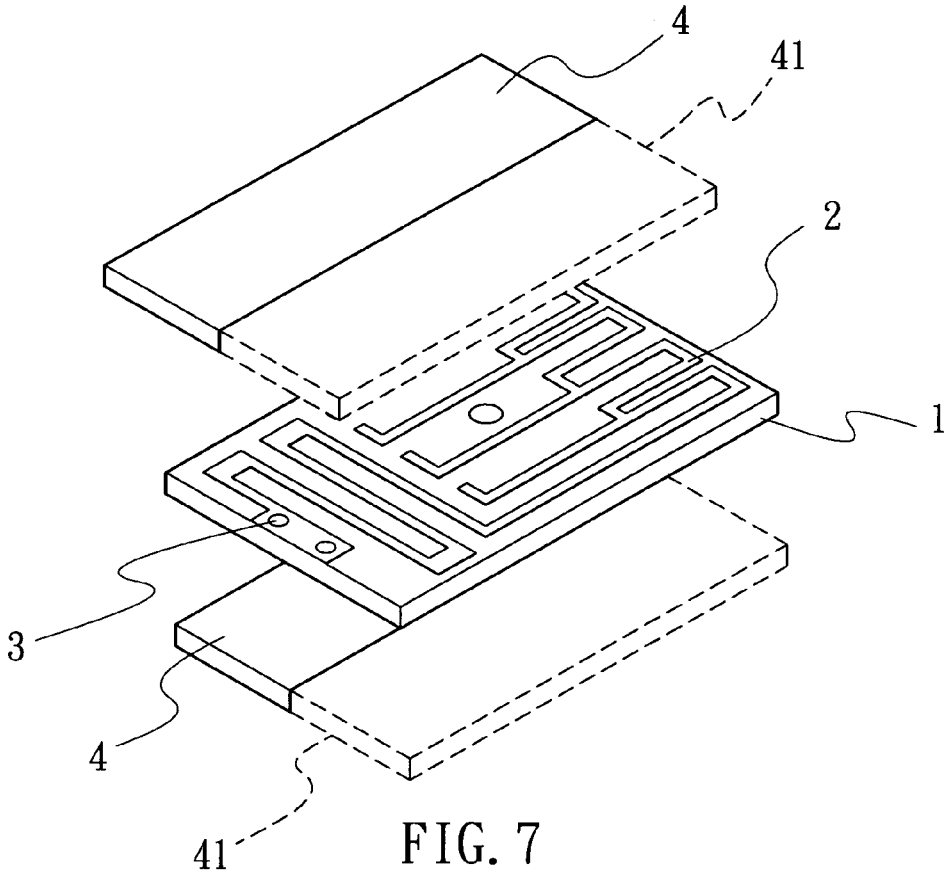
FIG. 7 is a cross-sectional view for the forth embodiment of the invention.
Figure 8:
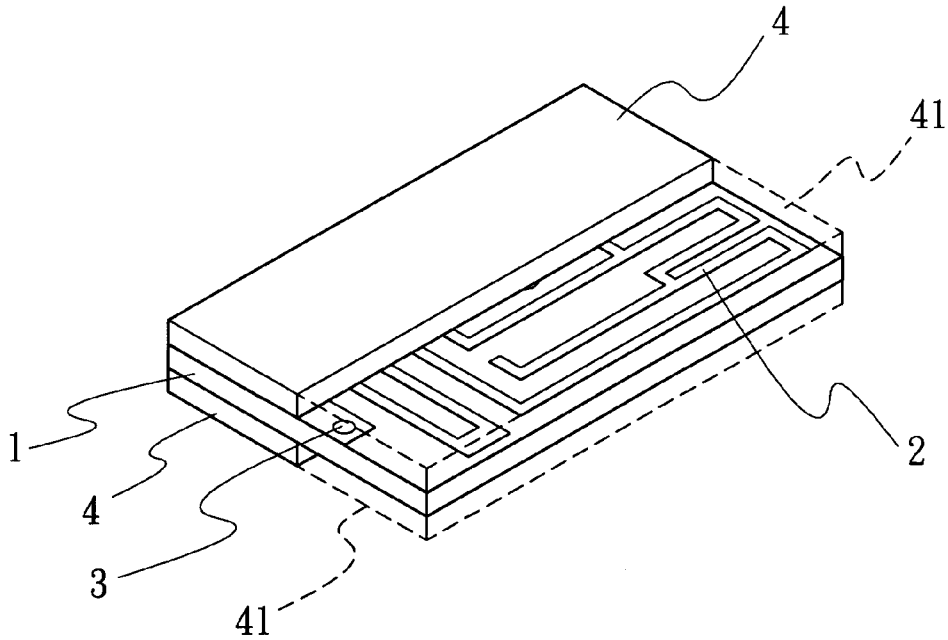
FIG. 8 is a top perspective view of the fourth embodiment of the invention.
Figure 9:
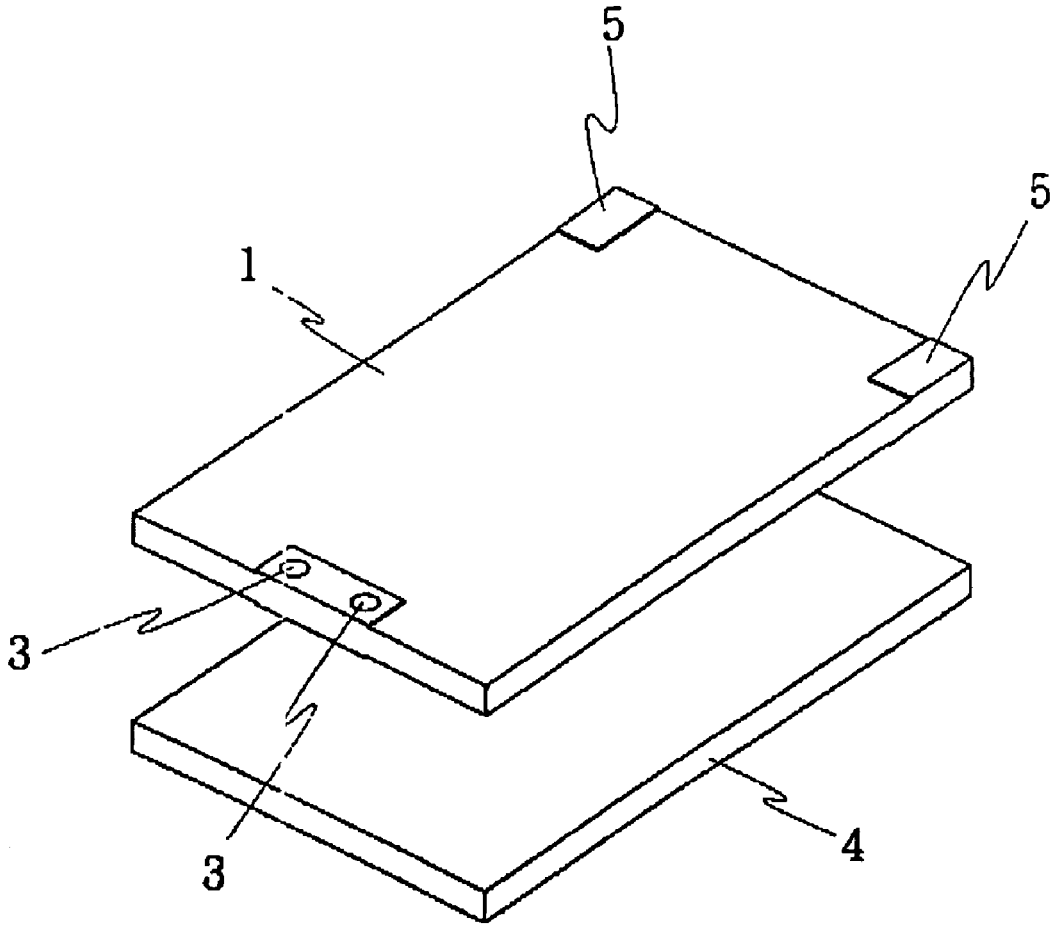
FIG. 9 is a bottom perspective view of an embodiment of the invention.

The packaging material 4 and the dielectric substrate 1 having antenna radiation conductor paths can be packaged by the ways of single surface packaging, or by double surface packaging as illustrated in FIGS. 3 and 4. Or as illustrated in FIGS. 5 and 6, the invention also can be packaged by the way of partial single surface packaging. Or as illustrated in FIGS. 7 and 8, it can be packaged by the way of partial double surface packaging.

In the above-mentioned single surface or double surface packaging, the size of packaging material can be a partial section of the lower substrate 1, and the other part of the substrate 1 is uncovered (or fill by air). So the surface package can combine with any non-packaging material 4 to be the component (e.g. the other partial section can be another material, which is different form packaging material 4)

In other words, the above-mentioned packaging material 4 can be composed by two or more different materials. To sum up, the invention proposes the method for manufacturing microchip antenna, and the method is a creative and progressive design undoubtedly.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claim is:

1. A method for manufacturing microchip antenna comprising the steps of:

forming on a dielectric substrate antenna radiation conductor paths comprising at least one feeding point and multiple-curved paths;

packaging said dielectric substrate with a packaging material having a dielectric constant that is easily adjustable, wherein a central frequency of the antenna is adjusted by adjusting the dielectic constant of the packaging material;

wherein said packaging material comprises thermal plastic high molecular materials or thermal setting high molecular materials, and ceramic powders or fiber with various components and ratios; wherein the dielectric constant is adjusted by adjusting the components and ratios; and wherein the dielectric substrate with the conductor paths is packaged by embedding type injection molding, two-material injection molding, mold-filling, screen thick film printing, or transfer printing so as to package the dielectric substrate with said packaging material.

2. The method for manufacturing microchip antenna as claimed in claim 1, wherein the dielectric substrate is one of a printed circuit board, a plastic board, a resin-ceramic compound board, a ceramic board and a wafer.

3. The method for manufacturing microchip antenna as claimed in claim 2, wherein the resin of a resin board and a resin-ceramic compound board is one of a thermal plastic high molecules material and thermal setting high molecules material.

4. The method for manufacturing microchip antenna as claimed in claim 2, wherein the dielectric substrate is formed using a single layer of substrate or multiple layers of substrate with the same dielectric constant or various dielectric constants.

5. The method for manufacturing microchip antenna as claimed in claim 1, wherein the packaging material and the dielectric substrate are packaged by the way of single surface packaging.

6. The method for manufacturing microchip antenna as claimed in claim 1, wherein the packaging material and the dielectric substrate are packaged by way of partial single surface packaging.

7. The method for manufacturing microchip antenna as claimed in claim 1, wherein the packaging material and the dielectric substrate are packaged by way of partial double surface packaging.

8. A method for manufacturing microchip antenna comprising the steps of:

forming on a dielectric substrate antenna radiation conductor paths comprising at least one feeding point and multiple-curved paths;

providing a packaging material having a dielectric constant that is easily adjustable, the packaging material comprising thermal plastic high molecular materials or thermal setting high molecular materials and ceramic powders or fiber with various components and ratios, wherein the dielectric constant of the packaging material is adjusted by adjusting the components and ratios to obtain a desired dielectric constant;

injection molding said packaging material on said dielectric substrate to form a package for said dielectric substrate, wherein a central frequency of the antenna is set according to said dielectic constant of the packaging material.

9. A method for manufacturing microchip antenna comprising the steps of:

forming on a dielectric substrate antenna radiation conductor paths comprising at least one feeding point and multiple-curved paths;

providing a packaging material having a dielectric constant that is easily adjustable, the packaging material comprising thermal plastic high molecular materials or thermal setting high molecular materials and ceramic powders or fiber with various components and ratios, wherein the dielectric constant of the packaging material is adjusted by adjusting the components and ratios to obtain a desired dielectric constant; and forming a package for said dielectric substrate from said packaging material;

whereby a central frequency of the antenna is set by the dielectic constant of the packaging material.

* * * * *